US012264453B2

(12) United States Patent
Meschke et al.

(10) Patent No.: US 12,264,453 B2
(45) Date of Patent: Apr. 1, 2025

(54) PNEUMATIC EXCAVATOR AND METHODS OF USE

(71) Applicant: Sonny's HFI Holdings, LLC, Wilmington, DE (US)

(72) Inventors: Timothy Meschke, Carver, MN (US); Ian Taylor, Inver Grove Heights, MN (US); Nathan Schlueter, Bloomington, MN (US); Chris Schuelke, Elk River, MN (US); Dave Rohrbach, Troy, OH (US)

(73) Assignee: Sonny's HFI Holdings, LLC, Wilmington, DE (US)

( * ) Notice: Subject to any disclaimer, the term of this patent is extended or adjusted under 35 U.S.C. 154(b) by 0 days.

(21) Appl. No.: 18/416,112

(22) Filed: Jan. 18, 2024

(65) Prior Publication Data

US 2024/0254726 A1 Aug. 1, 2024

Related U.S. Application Data

(60) Provisional application No. 63/441,954, filed on Jan. 30, 2023.

(51) Int. Cl.

| | |
|---|---|
| ***E02F 3/92*** | (2006.01) |
| ***E02F 3/88*** | (2006.01) |
| ***E02F 5/00*** | (2006.01) |

(52) U.S. Cl.

CPC ..... *E02F 3/9206* (2013.01); *E02F 3/8891* (2013.01); *E02F 5/003* (2013.01)

(58) Field of Classification Search

CPC ..... E02F 3/9206; E02F 3/8891; E02F 3/925; E02F 5/003; E02F 9/2267

See application file for complete search history.

(56) References Cited

U.S. PATENT DOCUMENTS

| | | | |
|---|---|---|---|
| 521,883 | A | 6/1894 | Holland |
| 3,125,819 | A | 3/1964 | Kaufmann |

(Continued)

FOREIGN PATENT DOCUMENTS

| | | | |
|---|---|---|---|
| EP | 0251660 | A1 * | 1/1988 |
| EP | 0566543 | A1 * | 10/1993 |

(Continued)

OTHER PUBLICATIONS

Invitation to Pay Additional Fees dated Apr. 26, 2024 in connection with International Patent Application No. PCT/US2024/013280, 4 pages.

(Continued)

*Primary Examiner* — Adam J Behrens
*Assistant Examiner* — Blake E Scoville
(74) *Attorney, Agent, or Firm* — Dorsey & Whitney LLP

(57) ABSTRACT

A pneumatic excavator includes: a barrel with an ingress configured to be fluidly connected to a supply of compressed air and an egress; an actuator; a releasable coupling to lock the actuator to the barrel in a plurality positions; and a flow valve fixedly arranged to the barrel, the flow valve in a communicative coupling with the actuator by an actuation conduit. The actuation conduit is flexible and slaved by an adjustment movement of the releasable coupling and actuator along the barrel to thereby maintain the communicative coupling therebetween. When the actuator is actuated, the actuation conduit sends causes the flow valve to open and the compressed air passes through the flow valve and exits the pneumatic excavator, and when the actuator is released, the actuation conduit sends a signal to the flow valve to close to prevent the compressed air from passing through the flow valve.

20 Claims, 9 Drawing Sheets

(56) References Cited

U.S. PATENT DOCUMENTS

| | | | | |
|---|---|---|---|---|
| 3,670,514 | A | 6/1972 | Breston et al. | |
| 3,881,530 | A | 5/1975 | Faldi | |
| 4,114,723 | A | 9/1978 | Paitson et al. | |
| 4,176,487 | A | 12/1979 | Manis | |
| 4,253,255 | A | 3/1981 | Durell | |
| 4,331,140 | A | 5/1982 | Hallsey | |
| 4,377,168 | A | 3/1983 | Rzasa et al. | |
| 4,412,656 | A | 11/1983 | Beck | |
| 4,936,031 | A | 6/1990 | Briggs et al. | |
| 4,991,321 | A | 2/1991 | Artzberger | |
| 5,016,717 | A | 5/1991 | Simons et al. | |
| 5,140,759 | A | 8/1992 | Artzberger | |
| 5,170,943 | A * | 12/1992 | Artzberger | E02F 3/9206 239/290 |
| 5,186,392 | A | 2/1993 | Pleshek | |
| 5,212,891 | A | 5/1993 | Schuermann et al. | |
| 5,220,935 | A | 6/1993 | Bailey et al. | |
| 5,244,364 | A | 9/1993 | Laco et al. | |
| 5,263,504 | A | 11/1993 | Bailey et al. | |
| 5,487,229 | A | 1/1996 | Nathenson et al. | |
| 5,782,414 | A | 7/1998 | Nathenson | |
| 5,785,067 | A | 7/1998 | Kosofsky | |
| 5,803,982 | A | 9/1998 | Kosofsky et al. | |
| 5,806,616 | A | 9/1998 | Enlund et al. | |
| 5,832,974 | A | 11/1998 | Jou | |
| 5,860,232 | A | 1/1999 | Nathenson et al. | |
| 5,966,847 | A * | 10/1999 | Nathenson | E02F 3/9206 137/874 |
| 5,976,268 | A | 11/1999 | Eliason et al. | |
| 5,993,117 | A | 11/1999 | Lancaster et al. | |
| 5,996,847 | A | 12/1999 | Smolen et al. | |
| D435,207 | S | 12/2000 | Nathenson et al. | |
| 6,158,152 | A * | 12/2000 | Nathenson | E02F 3/9206 239/532 |
| 6,202,330 | B1 | 3/2001 | Bolton | |
| 6,283,340 | B1 * | 9/2001 | Waldner | B05B 1/005 222/530 |
| 6,397,878 | B1 | 6/2002 | Nolan | |
| 6,470,605 | B1 | 10/2002 | Gilman et al. | |
| 6,615,849 | B1 | 9/2003 | Gilman et al. | |
| 6,618,966 | B2 * | 9/2003 | Russo | E02F 3/9206 175/212 |
| 7,475,831 | B2 | 1/2009 | Van et al. | |
| 7,631,444 | B1 | 12/2009 | Hursen | |
| 7,676,965 | B1 | 3/2010 | Nathenson et al. | |
| 7,677,476 | B2 * | 3/2010 | Burdsall | B08B 3/026 239/525 |
| 9,056,328 | B2 | 6/2015 | Giovannini | |
| 9,382,688 | B2 | 7/2016 | Buckner | |
| 9,475,174 | B2 | 10/2016 | Hursen | |
| 9,855,573 | B2 | 1/2018 | Hursen | |
| D865,120 | S | 10/2019 | Tibell et al. | |
| 10,603,780 | B2 | 3/2020 | Hursen | |
| 10,792,681 | B2 | 10/2020 | Alves | |
| 10,920,397 | B2 | 2/2021 | Buchleiter et al. | |
| 11,278,940 | B2 | 3/2022 | Takada et al. | |
| 2006/0065309 | A1 | 3/2006 | Leasure et al. | |
| 2008/0040945 | A1 | 2/2008 | Buckner | |
| 2009/0255272 | A1 | 10/2009 | Tibell | |
| 2009/0284068 | A1 | 11/2009 | Yu et al. | |
| 2010/0095559 | A1 | 4/2010 | Buckner | |
| 2010/0196129 | A1 | 8/2010 | Buckner | |
| 2011/0296646 | A1 | 12/2011 | Showley | |
| 2012/0007009 | A1 | 1/2012 | Yie | |
| 2013/0185966 | A1 | 7/2013 | Harrington | |
| 2013/0189060 | A1 | 7/2013 | Lamonte | |
| 2013/0340297 | A1 | 12/2013 | Buckner | |
| 2014/0020268 | A1 | 1/2014 | Buckner | |
| 2014/0130382 | A1 | 5/2014 | Harrington | |
| 2014/0231326 | A1 | 8/2014 | Biley et al. | |
| 2015/0176243 | A1 | 6/2015 | Buckner | |
| 2016/0207057 | A1 | 7/2016 | Hursen | |
| 2020/0070180 | A1 | 3/2020 | Tibell | |
| 2023/0080378 | A1 | 3/2023 | Richter et al. | |
| 2024/0254723 | A1 | 8/2024 | Meschke et al. | |
| 2024/0254724 | A1 | 8/2024 | Meschke et al. | |
| 2024/0254725 | A1 | 8/2024 | Meschke et al. | |

FOREIGN PATENT DOCUMENTS

| | | | |
|---|---|---|---|
| EP | 1803980 | A1 | 7/2007 |
| WO | 2017217916 | A1 | 12/2017 |
| WO | 2024163314 | A2 | 8/2024 |

OTHER PUBLICATIONS

International Search Report and Written Opinion dated Jul. 10, 2024 in connection with International Patent Application No. PCT/US2024/013280, 17 pages.

* cited by examiner

PNEUMATIC EXCAVATOR AND METHODS OF USE

CROSS-REFERENCE TO RELATED APPLICATIONS

This application claims the benefit of U.S. Provisional Patent Application No. 63/441,954, filed Jan. 30, 2023, entitled "PNEUMATIC EXCAVATOR AND METHODS OF USE", which relates to commonly owned U.S. Provisional Patent Application No. 63/441,957, filed Jan. 30, 2023, entitled "PNEUMATIC EXCAVATOR AND METHODS OF USE", U.S. Provisional Patent Application No. 63/441,961, filed Jan. 30, 2023, entitled "PNEUMATIC EXCAVATOR AND METHODS OF USE", and U.S. Provisional Patent Application No. 63/441,966, filed Jan. 30, 2023, entitled "PNEUMATIC EXCAVATOR AND METHODS OF USE", each of which are herein incorporated by reference in their entireties for any useful purpose.

TECHNICAL FIELD

Implementations are directed to excavators, and more particularly to hand-held pneumatic excavators and methods of use.

BACKGROUND

Compressed air excavators cause compressed air to exit from a nozzle disposed at an end of an open pipe, which may be useful in operations such as loosening soil from buried pipes, gas mains, cables and cleaning. In prior approaches, pressurized water directed at the soil resulted in the generation of hazardous waste by the water mixing with contaminants in the soil that requires special treatment prior to disposal. In other approaches, mechanical digging implements such as blades and picks having hard cutting edges often damage the objects to be excavated or cleaned. The use of compressed air has the advantage of avoiding generation of hazardous waste while loosening soil without causing damage to the object targeted.

SUMMARY

According to implementations, a pneumatic excavator may include an elongated barrel having an ingress and an egress, said ingress configured to be fluidly connected to a supply of compressed air, said egress defining an outlet of the pneumatic excavator; an actuator including an actuation switch; a releasable coupling configured to releasably couple the actuator to the barrel in a plurality of locked positions along a length of the barrel, such that the actuator is movably coupled to an exterior of the barrel; and a flow valve fixedly arranged to the barrel, where the flow valve is in a communicative coupling with the actuator by an actuation conduit. The actuation conduit may be flexible and slaved by an adjustment movement of the actuator relative to the flow valve along the length of the barrel to thereby maintain the communicative coupling therebetween such that when the actuator is actuated, the actuation conduit may send a signal to the flow valve to move to an open position and the compressed air passes through the flow valve and the barrel and exits the pneumatic excavator through the outlet, and when the actuator is released, the actuation conduit may send a signal to the flow valve to move to a closed position to prevent the compressed air from passing through the flow valve.

In various implementations and alternatives, the actuation conduit may be configured as tubing, where the signal from the tubing is compressed air emitted from the actuator. In such implementations and alternatives, the tubing may include a first tubing and a second tubing, the first tubing extending between a first port of the actuator and a first port of the flow valve, the second tubing extending between a second port of the actuator and a second port of the flow valve. In addition or alternatively, the tubing may be coiled tubing configured to be coiled around or strung along the barrel. In addition or alternatively, the tubing may be telescopic.

In various implementations and alternatives, the actuation conduit may include an electrical conduit, where the signal from the tubing is an electrical signal emitted from the actuator.

In various implementations and alternatives, the releasable coupling may include a sleeve-shaped portion surrounding the barrel, which may be locked and unlocked by a locking mechanism. In such implementations and alternatives, the locking mechanism may include a clamp.

In various implementations and alternatives, the actuator may further include a first handle, where the first handle is configured to be held by one hand of a user and provide access to the actuation switch by the one hand. In such implementations and alternatives, a second handle may be positioned on the exterior of the barrel. For instance, the second handle may be configured to releasably couple to the barrel in a plurality of locked positions along the length of the barrel independent from the releasable coupling.

In various implementations and alternatives, a handle positioned on the exterior of the barrel, and in such implementations and alternatives, the handle may be configured to releasably couple to the barrel in a plurality of locked positions along the length of the barrel independent from the releasable coupling.

In various implementations and alternatives, the actuator may be a primary actuator, and the pneumatic excavator may further include a safety mechanism including a secondary actuator, where the actuation switch and the secondary actuator are both actuated for the primary actuator to be actuated. In such implementations and alternatives, the actuation switch and the secondary actuator may be separately arranged on the barrel such that the actuation switch is configured to be depressed by one hand of a user and the secondary actuator is configured to be depressed by another hand of the user. In addition or alternatively, the releasable coupling may be a first releasable coupling, and the pneumatic excavator may further include a second releasable coupling, the second releasable coupling including the secondary actuator, and where the first releasable coupling and the second releasable coupling are movable relative to each other along the length of the barrel.

In various implementations and alternatives, a nozzle may be coupled to the egress of the barrel and may define the outlet of the pneumatic excavator. In addition or alternatively, an adjustable shield may be slidably arranged on the barrel proximate the distal end.

According to other implementations, a method of operating a pneumatic excavator including a movable actuator may involve: adjusting a position of a releasable coupling including an actuator along a length of an elongated barrel of the pneumatic excavator, the pneumatic excavator including a flexible actuation conduit forming a communicative coupling between actuator and a flow valve fixedly arranged on the barrel, and where the actuation conduit is slaved by the adjusting to thereby maintain the communicative coupling; locking the releasable coupling to the barrel; supplying compressed air to an ingress of the flow valve; and actuating the actuator such that the actuation conduit sends a signal to the flow valve to move to an open position and the compressed air passes through the flow valve and the barrel and exits the pneumatic excavator through the outlet.

In various implementations and alternatives, the method may further involve releasing the actuator such that the actuation conduit sends a signal to the flow valve to move to a closed position to prevent the compressed air from passing through the flow valve.

DETAILED DESCRIPTION

Figure 1:
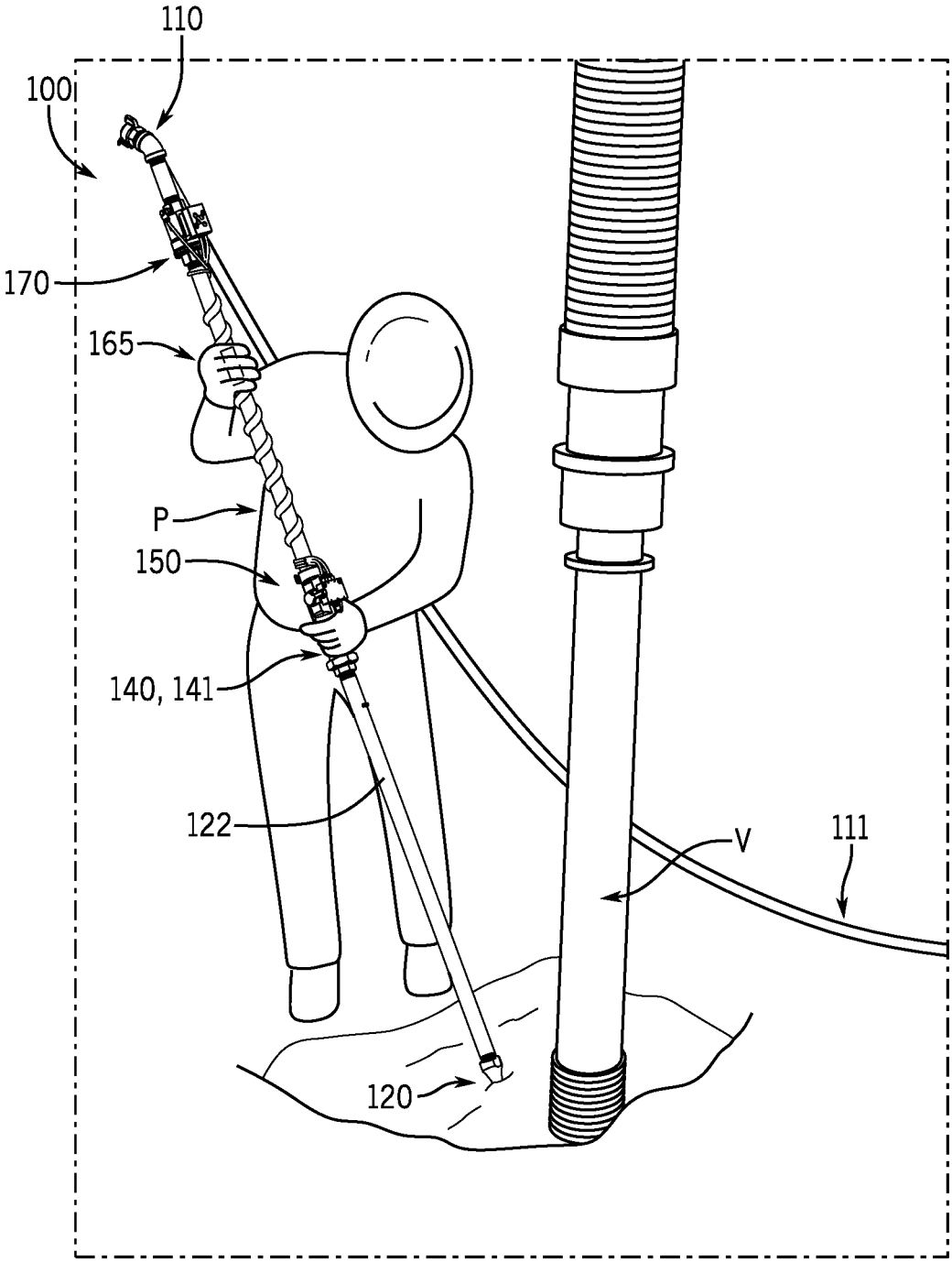
FIG. 1 illustrates a pneumatic air excavator in use in an excavating operation, according to implementations of the present disclosure.

Turning to the Figures, FIG. 1 illustrates a pneumatic air excavator 100 of the present disclosure in an exemplary soil excavating operation. A proximal end 110 of the pneumatic air excavator 100 is removably coupled to an air supply via an elongated delivery line 111. The air supply may be compressed or pressurized air, which may be provided by an air compressor such as an air compressor truck. The air supply may be air (e.g., a mixture of oxygen and nitrogen), a gas or a mixture. A distal end 120 of the pneumatic air excavator 100 may include an extension 122 and a nozzle 130 (see, e.g., FIG. 2A) configured to deliver the compressed air, for instance, to break apart soil covering a buried target object, e.g., a pipe, cable, or other structure(s). A barrel 140 extending between the proximal and distal end 110, 120 of the pneumatic air excavator 100 may be held by a user P during use. The barrel 140 may include an actuator assembly 150 movably coupled to an exterior 141 of the barrel 140 by a releasable coupling 160 (see, e.g., FIG. 2A). The actuator assembly 150 may be held by one hand of the user P for controlling an on/off status of the pneumatic air excavator 100, while a different region of the pneumatic air excavator 100 may be held by the other hand of the user P, such as at a safety mechanism 165 proximate a primary valve or flow valve 170. As the soil is loosened during operation of the pneumatic air excavator 100, an industrial vacuum V may extract the loosened soil and may for instance deposit the soil in a location for future use or removal.

Figure 2A:
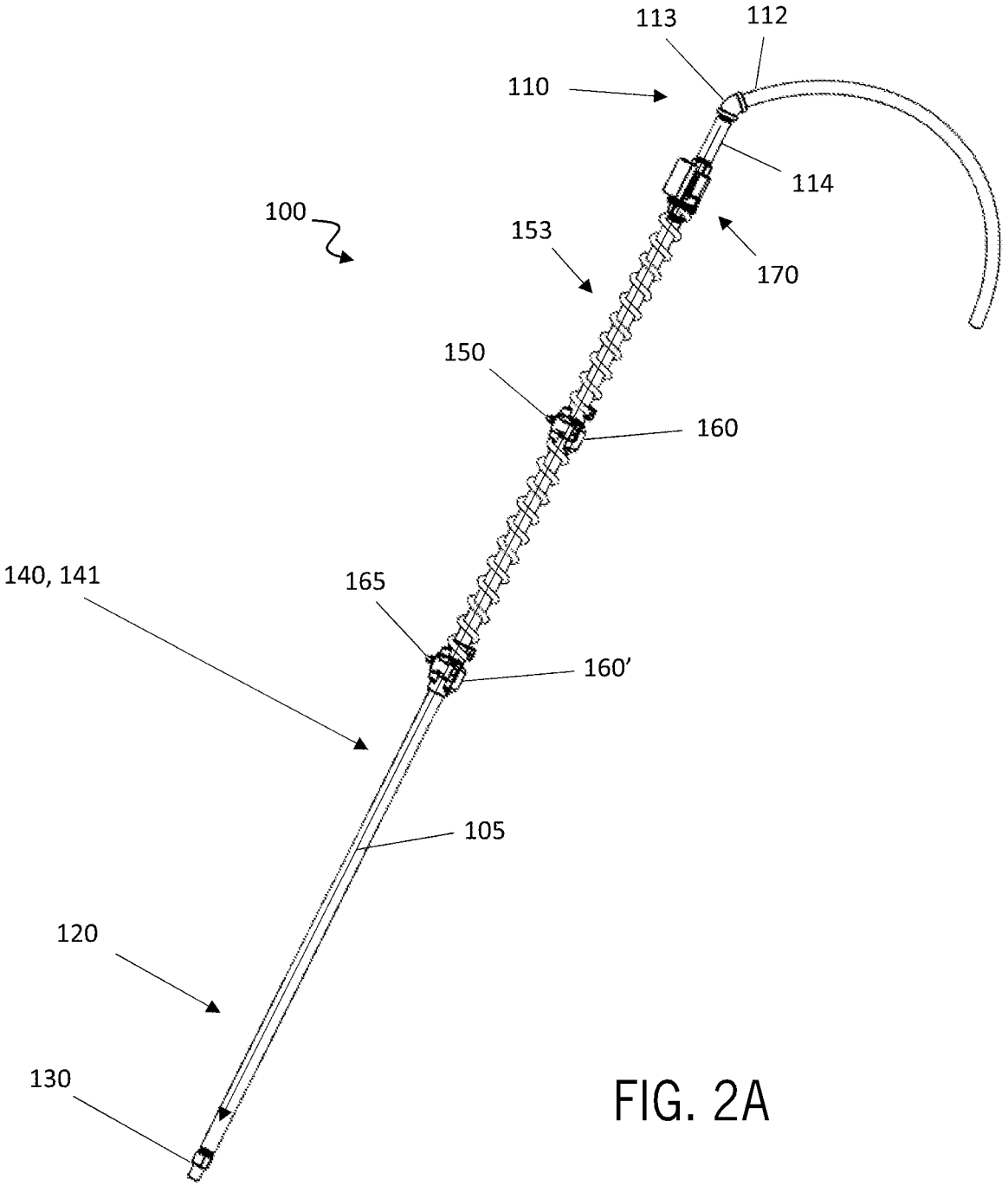
FIGS. 2A, 2B and 2C illustrate a first isometric view, an exploded isometric view, and a second isometric view, respectively, of the pneumatic air excavator, according to implementations of the present disclosure.
Figure 2B:
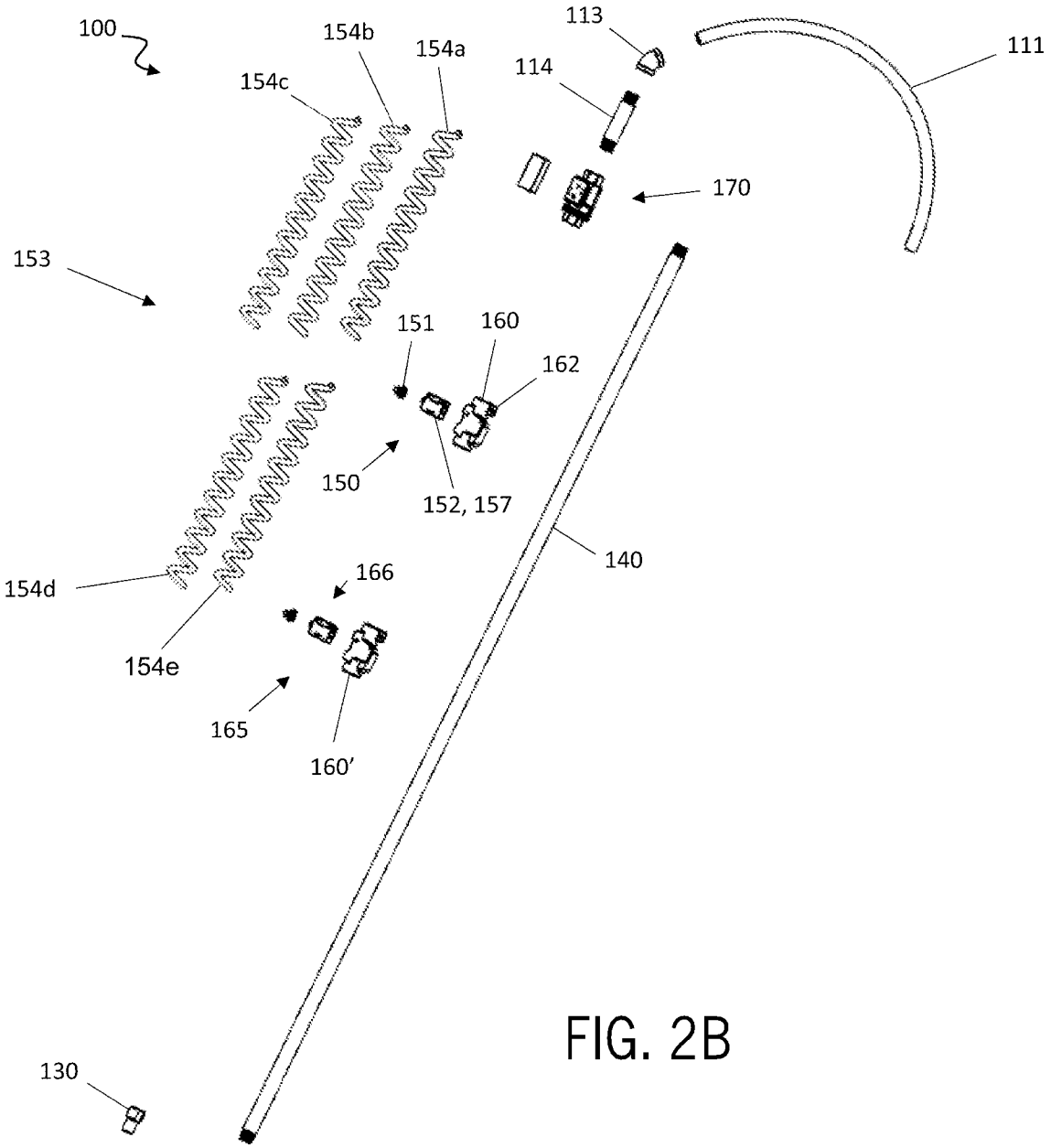

FIGS. 2A and 2B illustrate an isometric view and an exploded isometric view, respectively, of the pneumatic air excavator 100 of the present disclosure. As shown in FIG. 2A, components of the pneumatic air excavator 100 may be coaxially arranged such as the nozzle 130, barrel 140, portions of the actuator assembly 150, the releasable coupling 160, a safety mechanism 165 and the primary flow valve 170. A primary flow passage 105 of the pneumatic air excavator 100 may extend along a central axis thereof and may be defined at least by the flow valve 170, the barrel 140 and nozzle 130.

Figure 2C:
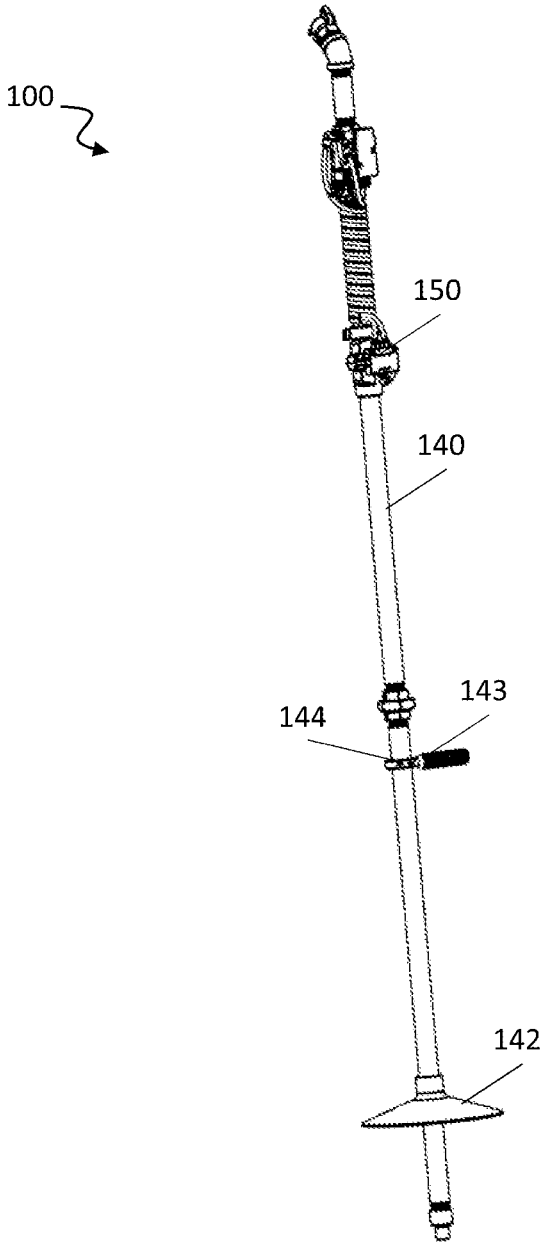
Figure 2D:
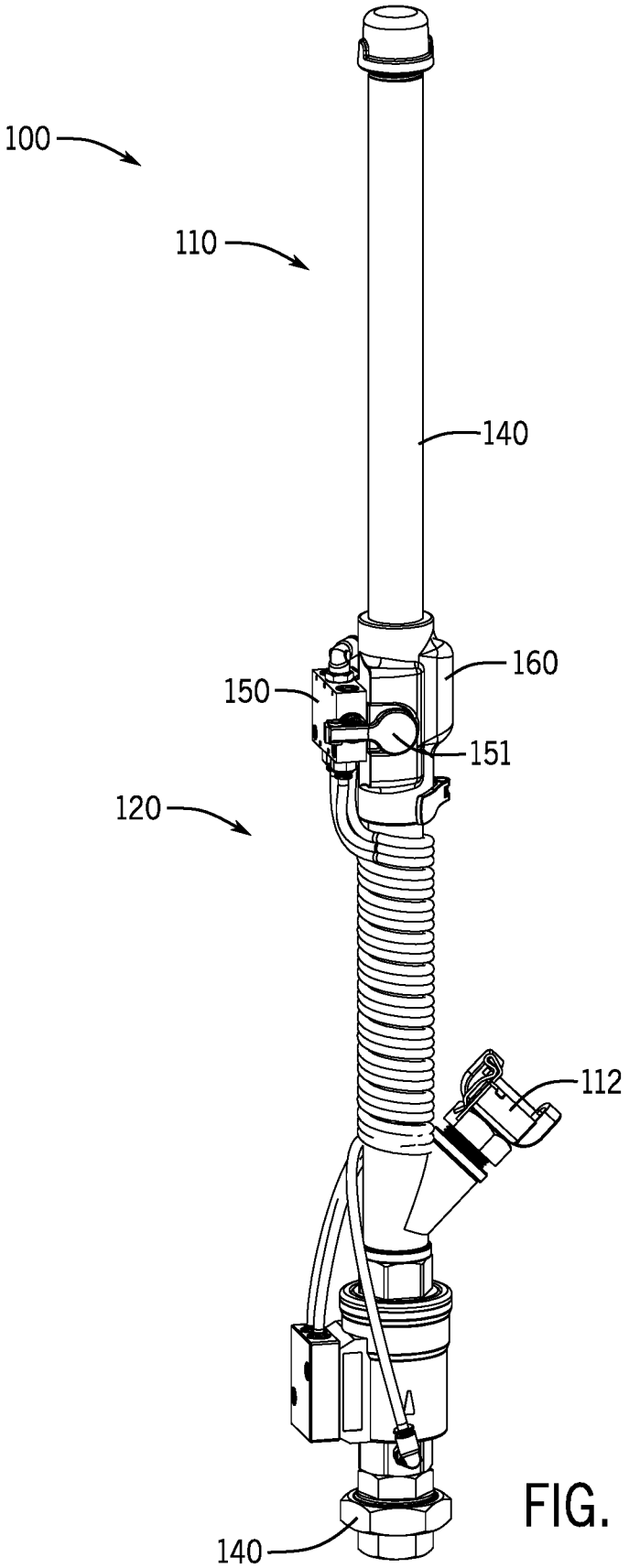
FIG. 2D shows the pneumatic air excavator with an alternative fitting position, according to implementations of the present disclosure.

At the proximal end 110 of the air excavator 100, a port or fitting 112 may be provided for removably connecting to the air supply via the delivery line 111 to establish a fluid coupling to the air supply. For instance the delivery line 111 may include a fitting that is complementary to the fitting 112, or the two may otherwise be configured for coupling to one another directly or indirectly to provide an air tight connection. For instance, the fitting 112 may be a quick connect fitting, a claw connector such as a Chicago claw connector, or other air supply connection. The proximal end 110 may optionally include an angled conduit or pipe 113 and/or a straight conduit or pipe 114, each of which may for instance facilitate ergonomics of using the pneumatic air excavator 100 when coupled to the delivery line 111. Alternatively, the port or fitting 112 may be positioned at a distal end 120 of the air excavator 100, as shown in FIG. 2D, and for instance may be arranged distal to the actuator assembly 150 and the releasable coupling 160. In such case, the barrel 140 extending between the proximal and distal ends 110, 120 may enable the releasable coupling 160 to be moved to various positions along the barrel 140 and locked thereto, and this portion of the barrel 140, in some instances, may not receive airflow from the air supply, and may thereby provide flexibility in the configuration of the releasable coupling 160 and the barrel 140. Arrangement of the port or fitting 112 at the distal end 120 may lower the center of gravity of the pneumatic excavator to a more centralized position, for instance to provide better ergonomics and reduce fatigue. In such examples, the barrel 140 may be arranged both at the inlet end 179 of the flow valve 170 and the outlet end 178 of the flow valve 170 as shown in FIG. 2D.

The distal end 120 of the pneumatic air excavator 100 may define an outlet and may include a nozzle 130 coupled thereto. For instance, the nozzle 130 may be coupled to an egress of the barrel 140, and the nozzle 130 may define an outlet for the pneumatic excavator 100. The nozzle 130 may have various configurations depending on the desired delivery pressure and flow geometry emitted therefrom. For instance, the nozzle 130 may have a supersonic nozzle design. The nozzle 130 may be constructed of various materials such as metal including brass, stainless steel, composites such as polymers, reinforced polymers, a combined construction of metallic and polymer materials, and combinations thereof. The type of nozzle may include but is not limited to 30-300 cubic feet per minute (cfm) at 70 to 250 psi. The nozzle 130 may be interchangeable with other nozzles and may be releasably coupled to the distal end 120 such as via a threaded engagement or other fastening mechanism, e.g., quick connect. Alternatively, the nozzle 130 may be non-detachably connected to the distal end 120 of the pneumatic air excavator 100. In addition or alternatively, the nozzle 130 may include a non-conductive cover or coating, e.g., a rubber, polymer, of the like, for protecting the air excavator 100 and user from electrical shocks during excavation operations near power sources.

In some implementations, the distal end 120 of the pneumatic air excavator 100 may be formed of an optional barrel extension 122 as illustrated in FIG. 1. The barrel extension 122 may have the same or a different configuration as the barrel 140 of the pneumatic air excavator 100 and may be detachably coupled to the barrel 140 such as via a threaded collar or via another fastening mechanism such as those disclosed herein. The barrel extension 122 may enable the user P to use the pneumatic air excavator 100 in excavation applications at varying depths, and for instance, a longer extension 122 may be joined to the barrel 140 when the target object has a depth that is deeper than the length of the barrel 140. This may enable the user P to operate the pneumatic air excavator 100 more comfortably, as the user may operate the system in a standing position instead of a kneeling or bent position. In some implementations, the extension 122 and the barrel 140 may be telescopically arranged, and the length of the pneumatic air excavator 100 may be adjustable, such as by operating an adjustment collar that permits telescopic movement of the extension 122 relative to the barrel 140. The extension 122 may be constructed of the same or different material from the barrel 140, and for instance may be constructed of a non-conductive material such as fiberglass, plastics, rubbers, polymers, lined or coated material, aluminum, and so on.

The barrel 140 may define a portion of the primary flow passage 105 of the pneumatic air excavator 100 for delivering compressed air to the nozzle 130. The barrel 140 may be configured as a rigid, elongated tubular conduit having an ingress and an egress, and the ends may be coupled to various components as described herein, e.g., the ingress may be coupled to the delivery line 111 and the egress may be coupled to the nozzle 130 in a detachable or non-detachable manner. The barrel 140 may be constructed of a non-conductive material such as fiberglass, plastics, rubbers, polymers, lined or coated material, aluminum, and so on. In some implementations, an adjustable shield 142 may be slidably arranged on the barrel 140 proximate the distal end (FIG. 2C). The adjustable shield 142 may be cone-shaped and may deflect debris during an excavation operation.

The actuator assembly 150 of the pneumatic air excavator 100 may be arranged along the barrel 140 as shown in FIGS. 2A, 2C and 2D. The actuator assembly 150 may generally include an actuation switch and may be releasably coupled to the barrel 140 by the releasable coupling 160 described herein. The actuation switch of the actuator assembly 150 may include a trigger 151, e.g., a push button, coupled to a trigger valve 152. The trigger 151 may be biased by a biasing mechanism such as a spring or a solenoid valve. For instance, the trigger valve 152 may include a spool valve with a spool and spool pilot, where the spool is biased by a biasing mechanism such as a spring or solenoid valve, and the trigger 151 may move the spool against the bias force of the biasing mechanism. An actuation conduit 153 may at least be coupled between the actuator assembly 150 and the flow valve 170 and between the safety mechanism 165 and the actuator assembly. The actuation conduit 153 may be movably adjustable as provided herein and may include one or more conduits such as air hoses or conductive wires.

Operation of the actuation switch may cause the pneumatic air excavator 100 to be turned on and off. For instance, to activate the actuator assembly 150, the actuation switch may be moved to a closed position, e.g., by depressing the trigger 151. In response, the actuation conduit 153 coupled between the actuator assembly 150 and the flow valve 170 sends a signal to cause the main valve 170 to move to an open position, such that compressed gas from the delivery line 111 is permitted to pass through the main valve 170 as well as the primary flow passage 105 of the pneumatic air excavator 100 such that the compressed air exits through the nozzle 130. The actuator assembly 150 may be deactivated or released by the actuation switch moving to an open position, e.g., by releasing the trigger 151. Where the trigger valve 152 includes a biasing mechanism, deactivation may cause the trigger 151 to move to a normal position where the biasing mechanism, e.g., a return spring, is relaxed. In response, the actuation conduit 153 may send a signal to cause the flow valve 170 to move to a closed position to prevent the compressed gas from passing through the main valve 170 and thus the primary flow passage 105. The actuation conduit 153 may be a flexible conduit that can be extended and retracted along the barrel 140 of the pneumatic air excavator 100. For instance, the actuation conduit 153 may be configured as flexible air tubing (e.g., an air actuation conduit), as a flexible electrical conduit (e.g., a conductive wire), and may be coiled around the barrel 140, strung along the barrel 140, e.g., between the actuator assembly 150 and the flow valve 170, or may be telescopic along the barrel 140. In some implementations, a sleeve may cover the actuation conduit 153. The actuation conduit 153 may be provided as one or more conduits. For instance, one, two, three, four, five six, seven or more conduits may be provided in the actuation conduit.

Although the actuator assembly 150 is illustrated as being positioned on the releasable coupling 160, the actuator assembly 150 may alternatively be positioned on the flow valve 170 or another portion of the pneumatic air excavator 100. In addition or alternatively, although the actuator assembly 150 is illustrated as being positioned distal to the flow valve 170, the actuator assembly and, in some cases, the releasable coupling 160 carrying the actuator assembly 150, may alternatively be positioned proximal to the flow valve 170 of the pneumatic air excavator 100.

The releasable coupling 160 may be configured to releasably couple the actuator assembly 150 to the barrel 140 in a plurality of locked positions along a length of the barrel 140 when in a released position, and may be locked or fixed to the exterior 141 of the barrel 140 in the locked position. The releasable coupling 160 may include a sleeve-shaped portion 161 (FIG. 3) surrounding the barrel 140, which may be locked and unlocked by a locking mechanism 162 such as a clamp or a cam lock, e.g., clamping handle coupled to a split ring or clamp, for establishing a pinch, compression, and/or friction lock. The locking mechanism 162 may engage with the barrel 140 via a pinch or clamping mechanism along the external diameter of the barrel 140. In an unlocked position of the locking mechanism 162, the releasable coupling 160 may be in a released position and be moved or slid along the exterior 141 of the barrel 140, and due to the actuation conduit 153 being adjustable or flexible, movement of the releasable coupling 160 slaves the actuation conduit 153 along the barrel 140 of the pneumatic air excavator 100 (e.g., in an expansion or a retraction movement) and thus the coupling between the actuator assembly 150 and the flow valve 170 via the actuation conduit 153 can be maintained in any position of the actuator assembly 150 relative to the flow valve 170. The locking mechanism 162 of the releasable coupling 160 may be moved to a locked position to secure or lock the releasable coupling 160 to the exterior 141 of the barrel 140.

Figure 5A:
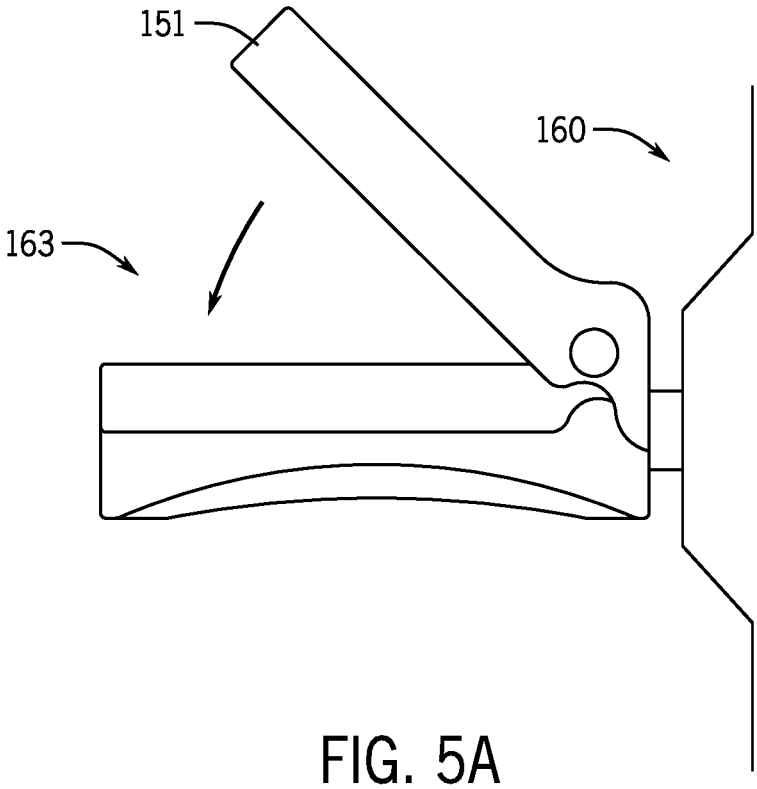
FIGS. 5A and 5B illustrate different positions of a handle of the pneumatic air excavator, according to implementations of the present disclosure.
Figure 5B:
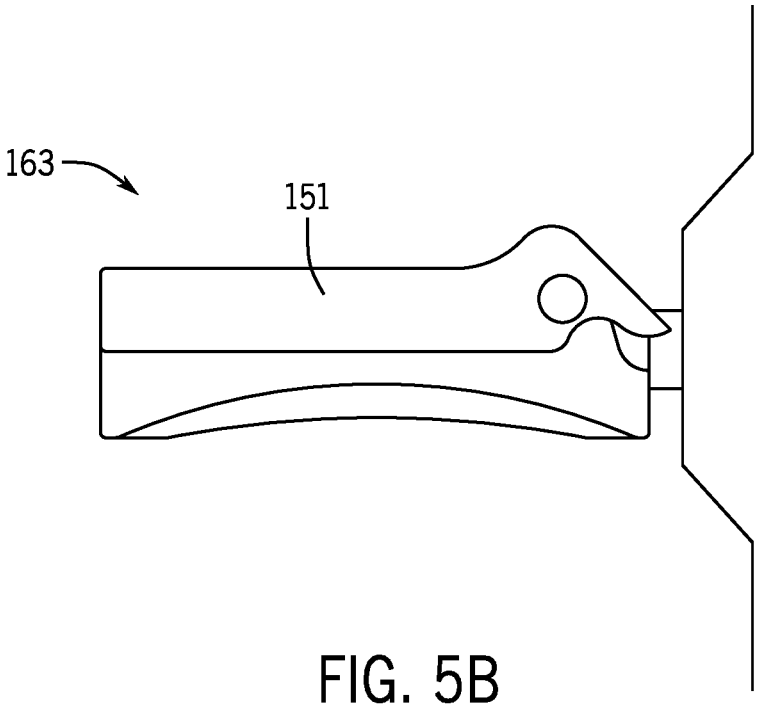

In some implementations, the sleeve-shaped portion 161 of the releasable coupling 160 may include the trigger 151 of the actuator assembly 150 coupled thereto, and for instance the trigger 151 may be arranged on or in the sleeve-shaped portion 161 to provide a user with a grippable portion via the sleeve-shaped portion that can be simultaneously used to actuate the actuator assembly 150 via the trigger 151 between an on and off state. In some implementations, the releasable coupling 160 may additionally include a handle 163 (FIGS. 5A and 5B), which may extend from the sleeve-shaped portion 161 and/or may be integrated with the sleeve-shaped portion 161. As shown in FIGS. 5A and 5B, the trigger 151 of the actuator assembly 150 may be integrated with the handle 163 of the releasable coupling 160 and the trigger 151 may be movable between an off position (FIG. 5A) and an on position (FIG. 5B). In some implementations, the handle 163 may be positioned perpendicularly, at an angle, or parallel relative to the releasable coupling 160 and the barrel 140. In addition, the handle 163 may be an adjustable handle that is adjustable to the aforementioned positions. It will be appreciated that the actuator assembly 150 and releasable coupling 160 may be integrated into an assembly configured to be held or gripped by a single hand of the user P to facilitate ergonomics and use of the pneumatic air excavator 100. In further implementations, a second handle 143 (FIG. 2C) may be releasably coupled to the barrel 140 using a second releasable coupling 144, e.g., a cam lock or clamp, and may be configured to be movable to a plurality of locked positions along the length of the barrel 140 independent from the releasable coupling 160.

In some implementations, a safety mechanism 165 may be included with the air excavator 100 configured to require actuation of primary and secondary actuators for the pneumatic excavator 100 to operate, which actuators may be arranged such that both hands of a user are required for actuation, e.g., by depressing the two actuators using separate hands. This may ensure that the operator always has two hands on the pneumatic excavator 100 during operation and reduces the chances of an accidental discharge. Accordingly, the safety mechanism 165 may include a secondary trigger or actuator 166, which may be operated in combination with the actuator assembly 150 (e.g., the actuation switch or trigger 151) in order for the user to operate of the pneumatic excavator 100. The actuator assembly 150 is also referred to as a primary actuator for purposes of discussion in connection with the secondary actuator 166. Depressing both the primary and secondary actuators 150, 166, respectively, may result in completion of a circuit that enables the flow valve 170 to receive a signal that causes movement to the open position (FIG. 4B) and flow of air through the primary passage 105. In such examples, depressing only one of the primary and secondary actuators 150, 166 may result in the flow valve 170 remaining in a closed position or moving to a closed position (FIG. 4A) for instance due to providing an incomplete circuit, such that the flow valve 170 is held in a closed position and/or is prevented from receiving a signal that otherwise can cause movement to the open position. The safety mechanism 165 may be coupled to the primary actuator 150 via the conduit 153, which may include one or more an air hoses 154*d*, 154*e* (FIG. 2B) and for instance the signal may be an air signal, such as compressed air. Alternatively, the conduit 153 may be configured to carry an electrical signal. The safety mechanism 165 may be arranged along the barrel 140 in a separate location from the actuator assembly 150. In some implementations, a releasable coupling 160' (FIG. 2A), e.g., a second releasable coupling, may include the safety mechanism 165 or components thereof integrated therein, and the releasable coupling 160' may be used to lock the safety mechanism 165 to the barrel 140. For instance, as shown in FIG. 2B, the actuator 166 of the safety mechanism may be provided on the releasable coupling 160' and arranged along the barrel 140 in a location separate from the other releasable coupling 160 and the primary actuator 150. Accordingly, the releasable couplings 160, 160' and their respective trigger 151 and actuator 166 may be movable relative to each other along the length of the barrel 140.

Figure 3:
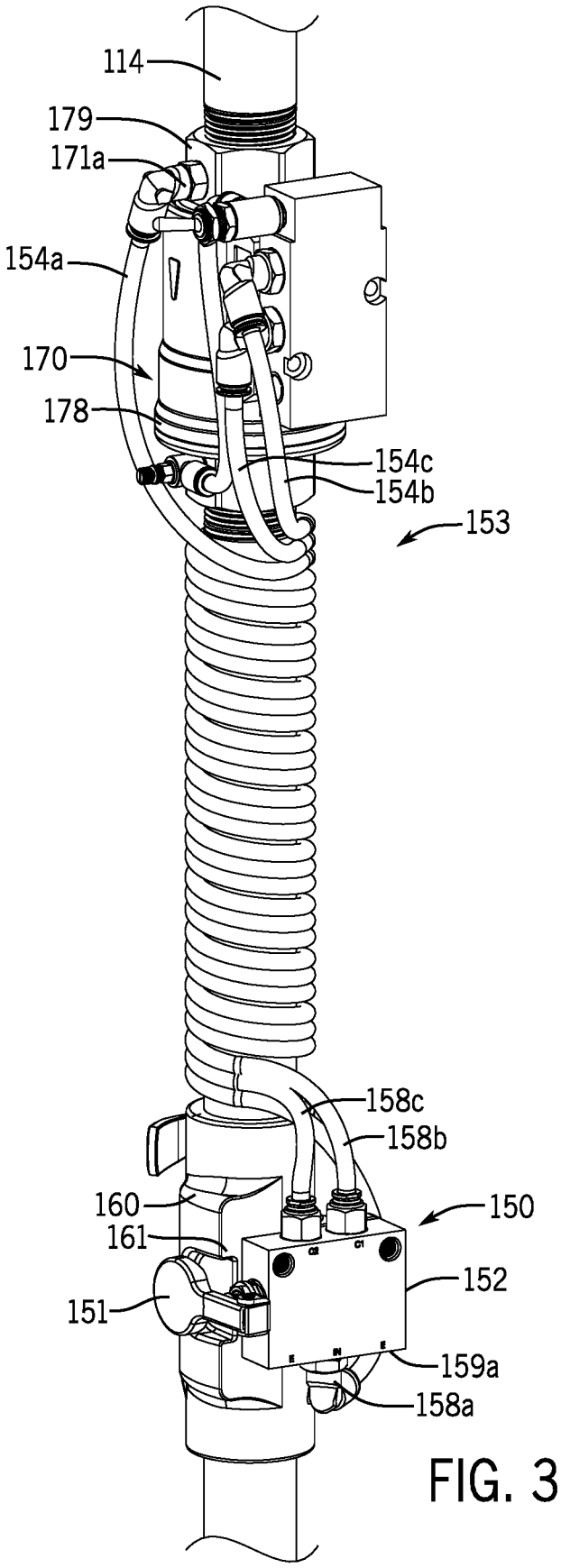
FIG. 3 illustrates a detail view of components of the pneumatic air excavator, according to implementations of the present disclosure.
Figure 4A:
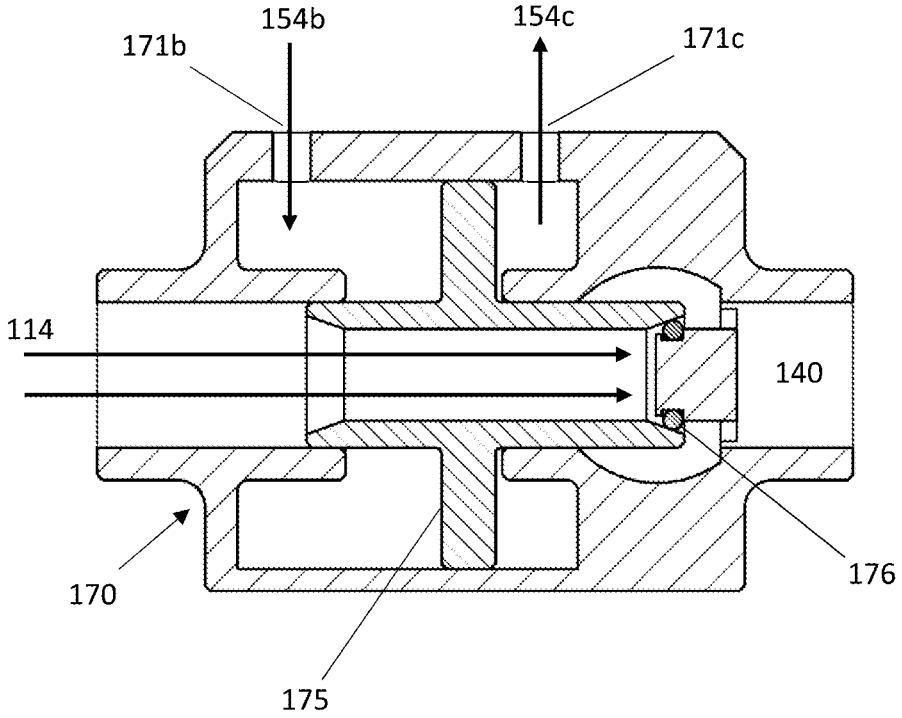
FIGS. 4A and 4B illustrate a valve of the pneumatic air excavator in a closed position and in an open position, respectively, according to implementations of the present disclosure.
Figure 4B:
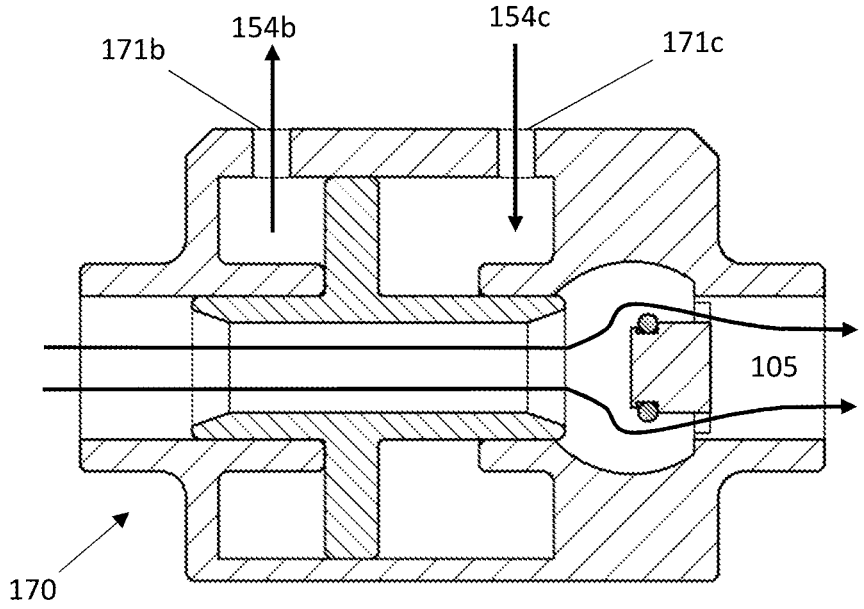

The flow valve 170 also referred to as a primary valve or main valve of the pneumatic excavator 100 may be arranged between the pipe 114 and the barrel 140 as illustrated in FIGS. 4A and 4B and may be responsible for delivering airflow through the pneumatic air excavator when in the actuated or open position. Referring to FIGS. 3, 4A and 4B, the flow valve 170 may include ports 171*a*, 171*b*, 171*c*, a piston 175, a valve seat 176, an outlet end 178 and an inlet end 179, where the portion of the flow valve 170 defining the primary flow passage 105 extends therebetween. In some implementations the flow valve 170 may be free of a return spring, such as where the flow valve 170 is pneumatically operated, while in other implementations, a mechanical biasing mechanism such as a return spring may be included in the flow valve 170. The flow valve 170 may be configured as a pneumatically piloted valve such as a coaxial valve, a double acting coaxial valve, as a solenoid actuated coaxial valve, as a pneumatic actuated angle seat valve or as a pneumatically actuated ball valve.

Ports 171*a*, 171*b*, and 171*c* of the flow valve 170 may be coupled to the actuator assembly 150 via the actuation conduit 153. For instance, referring to FIGS. 2B and 3, the actuation conduit 153 may include at least two flexible air hoses, such as three air hoses 154*a*, 154*b*, and 154*c*. Air hose 154*a* may be configured as a constant pressure conduit, a first end of which may be coupled to the pneumatic air excavator 100 at a port 171*a* upstream from the piston 175 of the flow valve 170, and the air hose 154*a* may extend to and be coupled to the actuator assembly 150, e.g., at port 158*a*, at a second end. Although the port 171*a* is illustrated as being defined in the flow valve 170, it will be understood that the port 171*a* may be defined in other portions of the pneumatic excavator 100 upstream from the flow valve 170. The air hose 154*a* may be constantly supplied compressed air when the delivery line 111 transmits pressurized air. Air hoses 154*b*, 154*c* may each be coupled to respective other ports 171*b*, 171*c* of the main valve 170 and to respective ports 158*b*, 158*c* of the housing 157 of the actuator assembly 150.

In implementations of use, the pneumatic air excavator 100 may be pneumatically turned on and off using the same compressed air supply that is used to operate the pneumatic air excavator 100. For instance, the actuation conduit 153 may include air hoses, e.g., air hoses 154*a*, 154*b*, and 154*c*. The air hoses may receive compressed air from the delivery line 111 or may carry compressed air emitted from the actuator assembly 150 to the flow valve 170. For instance, the compressed air received by the actuator assembly 150 may be derived from the air supply from the delivery line 111, and thus the actuator assembly 150 may receive the same compressed air supply that is used to operate the pneumatic air excavator 100, e.g., when the flow valve 170 is open and the compressed air passes through the primary flow passage 105.

In such implementations, actuation of the trigger 151 of the actuator assembly 150 may open a valve of the trigger valve 152, e.g., by movement of a spool against a biasing mechanism such as a return spring, to cause pressurized air from the actuator assembly 150 to enter the actuation conduit 153, e.g., air hose 154*c*, fluidly coupled to the main valve 170, and the actuation conduit 153 may deliver the pressurized air to a port, e.g., port 171*c*, of the main valve 170 to cause the main valve 170 to open and thereby permit pressurized air to flow through primary flow passage 105 of the pneumatic air excavator 100. Release of the trigger 151 may cause the trigger valve 152 to relax, for instance as a biasing force is released such as via relaxation of a spring, which may also cause pressurized air from the air supply to enter the actuation conduit 153, e.g., at air hose 154*b*, and be delivered to the main valve 170, but the pressurized air may be routed to another port, e.g., port 171*b* of the main valve 170 to close the main valve 170 and thereby prevent pressurized air from flowing through the primary flow passage 105 and exit the nozzle 130. Thus, the actuator assembly and the air hoses of the actuation conduit 153 may be configured to enable the actuator assembly 150 to pneumatically actuate and deactivate the pneumatic air excavator 100.

In implementations of use where the actuation conduit 153 includes an electrical conduit, the actuation conduit 153 may be configured to electrically actuate the pneumatic air excavator 100 between on and off modes. In examples, actuation of the trigger 151 may cause the trigger valve 152 to send an electrical signal to the flow valve 170 via the actuation conduit 153. When the trigger 151 is actuated, the signal sent by the trigger valve 152 to the flow valve 170 may cause the flow valve 170 to open and thereby permit pressurized air to flow through the primary flow passage 105. When the trigger 151 is released, the signal sent by the trigger valve 152 to the flow valve 170 may cause the flow valve 170 to close and thereby prevent pressurized air from flowing through the flow valve 170 and thus the primary flow passage 105. In some implementations, the flow valve 170 may include an electronic solenoid valve configured to open the flow valve 170 upon receiving the electronic signal from the trigger 151. Thus, the actuation conduit 153 may be configured to enable the actuator assembly 150 to electrically actuate and deactivate the pneumatic air excavator 100.

In implementations of use, the releasable coupling 160 may be movable along the barrel 140 at various stages of use of the pneumatic air excavator 100. For instance, the releasable coupling 160 may be used to adjust the position of the actuator assembly 150 prior to delivering compressed air through the delivery line 111, however, the releasable coupling 160 may be operated while the compressed air 111 is active. In examples, the trigger 151 of the actuator assembly 150 may be in an open, un-depressed state, the releasable coupling 160 may be unlocked, moved to a selected position, locked to the barrel 140, and then the trigger 151 may be depressed in an excavating operation. In other examples, the trigger 151 may be depressed in connection with an excavating operation while the releasable coupling is unlocked, moved to a new position, and locked to the barrel 140.

In some implementations of use, at least a portion of the actuator assembly 150 and releasable coupling 160 may be held by one hand of the user P to turn on and off the pneumatic air excavator 100. Due to the releasable coupling 160 being movable, the pneumatic air excavator 100 may be simplified because the user is allowed to select where along the barrel 140 to the actuator assembly 150 should be positioned and operated, for instance, depending on how the pneumatic air excavator 100 is being used or intended to be used, and move the releasable coupling 160 to the selected position. In addition to selecting where the user's hand will be on the air excavator 100 when operating the actuator assembly 150, this flexibility may also facilitate operation due to the ability to adjust and select where the user's other hand is positioned on the pneumatic air excavator 100 relative to the other hand on the actuator assembly 150. Thus, the releasable coupling 160 may provide an ergonomic approach to air excavation and operational control that has not otherwise not been possible.

Figure 6:
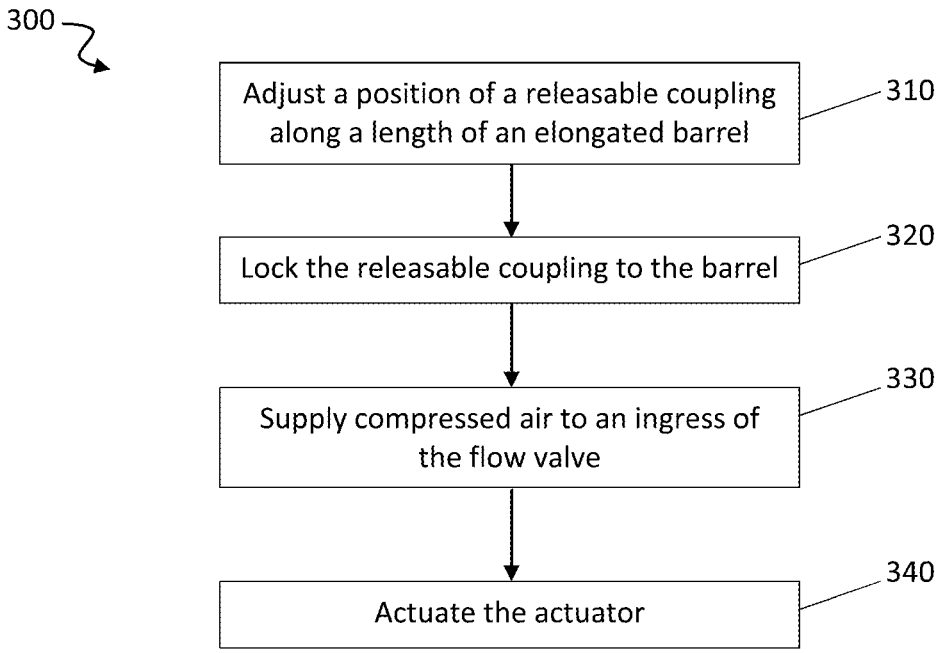
FIG. 6 illustrates a flow diagram of a method of actuating the pneumatic air excavator, according to implementations of the present disclosure.

According to implementations of use, as shown in the flow diagram of FIG. 6, a method 300 of operating a pneumatic excavator 100 including a movable actuator assembly 150 may involve, in operation 310, adjusting a position of a releasable coupling 160 including the actuator assembly 150 or components thereof, e.g., the trigger 151, along a length of the elongated barrel 140 of the pneumatic excavator 100 such that the flexible actuation conduit 153 is slaved by the adjusting to maintain a communicative coupling between the actuator assembly 150 and the flow valve 170. The method 300 may continue by locking the releasable coupling 160 to the barrel 140 in operation 320. For instance, a clamp of the releasable coupling may be locked to an exterior of the barrel 140. Compressed air may be supplied to an ingress of the flow valve 170 in operation 330. For instance, the compressed air may be supplied via delivery line 111 to the inlet end 179 of the flow valve 170. The actuator may be actuated in operation 340. During such actuation, a signal may be sent to the flow valve 170 to move the flow valve 170 to an open position (FIG. 4B) such that the compressed air at the inlet end 179 of the flow valve 170 is permitted to flow through the flow valve 170, through the primary flow passage 105 and exit the pneumatic excavator via the outlet. Following actuation, the actuator assembly 150 may be released and the actuation conduit may send a signal to the flow valve 170 to move to a closed position to prevent the compressed air from passing through the flow valve (FIG. 4A). Due to the actuation conduit 153 being flexible, the communicative coupling between the actuator assembly 150 and the flow valve 170 may thereby be maintained to enable the actuator assembly 150 to be moved to various locked positions along the barrel 140.

In the case of the actuation conduit being an air actuation conduit, the delivery line 111 may deliver compressed air to the actuator assembly 150 and to the flow valve 170 via the actuation conduit 153. For instance, prior to actuation of the actuator in operation 340 of method 300, the compressed air supply may be prevented from passing through the barrel 140 and exiting the nozzle 130 due to the flow valve 170 being in a closed position (FIG. 4A), and the piston 175 of the flow valve 170 may seal against a valve seat 176 of the flow valve 170. As provided herein, the air supply from the delivery line 111 may deliver compressed air to the actuator assembly 150, such as via the flexible air hose 154*a* of the actuation conduit 153 coupled between the flow valve 170 and the actuator assembly 150. More particularly, the air hose 154*a* may be coupled to the flow valve 170 at a port 171*a* positioned upstream of the piston 175 such that the compressed air is permitted to constantly pass through the flexible air hose 154*a* and to the actuator assembly 150 as long as the delivery line 111 is supplied with compressed air. The flexible air hose 154*a* may thus be configured as a constant pressure conduit that is constantly supplied compressed air. In this initial state of the pneumatic excavator 100 when the compressed air is supplied, the actuation switch of the actuator assembly 150 is in the open position and the compressed air from the air hose 154*a* is transmitted through the actuator assembly 150 to the flexible air hose 154*b* of the actuation conduit 153, which in turn transmits the compressed air to the port 171*b* of the flow valve 170 to force the piston 175 of the flow valve 170 against the valve seat 176 thereof to pneumatically force the flow valve 170 in a closed position, e.g., the compressed air is prevented from passing through the flow valve 170 and the primary flow passage 105.

Returning to method 300, upon actuating the actuator in operation 340, the actuator assembly 150 may move to a closed position, and compressed air may be transmitted from the actuator assembly 150 through the air hose 154*c* of the actuation conduit 153, to the flow valve 170 to cause the flow valve 170 to move to an open position (FIG. 4B) where the compressed air from the compressed air supply passes from the delivery line 111 and through the primary flow passage 105 of the pneumatic excavator 100 and exits the nozzle 130. In the open position of the flow valve 170, the piston 175 is pushed away from the valve seat 176 to permit air to pass through.

Releasing the actuator assembly 150 may result in moving the actuator assembly 150, e.g., the trigger valve 152, back to an initial or normal position, where the actuator assembly 150, e.g., its trigger 151, is in an open position. In this position, the compressed air may be transmitted from the actuator assembly 150 through the actuation conduit 153, e.g., air hose 154*b*, to the flow valve 170 to cause the flow valve 170 to again move to the closed position (FIG. 4A), where the flow valve 170 prevents the compressed air from passing therethrough, e.g., by the piston 175 of the flow valve 170 again sealing against a valve seat 176 of the flow valve 170.

In some implementations in which the safety mechanism 165 is included, the primary actuator 150, e.g., the trigger 151 and the safety mechanism 165, e.g., secondary actuator 166, both require actuation or depressing in order for the primary actuator 150 to be actuated. For instance, compressed air may first be received at the secondary actuator 166 and be delivered to the primary actuator 150 such that the compressed air can then be transmitted from the actuator assembly 150 through the air hose 154*c*, to the flow valve 170 to cause the flow valve 170 to move to the open position (FIG. 4B) as provided herein.

Accordingly, the actuator assembly 150 alone or the actuator assembly 150 and safety mechanism 165 may together be configured to pneumatically actuate the flow valve 170 via completion of a circuit to the flow valve 170, as provided herein. In addition, as provided herein, the primary actuator 150 and the safety mechanism 165 may be remotely arranged from each other, and from the flow valve 170 as illustrated in the Figures. Where pneumatically actuated, the pneumatic air excavator 100 may provide advantages because use of pressurized air as a means to trigger the flow valve 170 provides an efficient use of pressurized air at the actuator assembly 150 and the safety mechanism 165, when present, where a small air signal may be used, e.g., via the safety mechanism 165 and actuator assembly 150 including the aforementioned conduits, results in a short throw length or relay to cause a large pressure change at the flow valve 170 to cause the flow valve 170 to close and open (FIGS. 4A and 4B). A coaxial-style valve as illustrated in these figures, as well as other pneumatic valves such as ball or angled seat, may thus be operated using a small mechanical operator, like the trigger 151 and secondary actuator 166, to cause pressurized air to flow through the flow valve 170 as provided herein.

Venting may occur during operation of the compressed air excavator 100 to cause opposing pressure to be vented to the atmosphere. For instance, venting may occur at the actuator assembly 150 and the safety mechanism 165 when present. In some implementations, the flow valve 170 may be vented via one or more ports 171*b*, 171*c* when the valve is in the open and/or closed position to facilitate reliable operation of the pneumatic air excavator in the on and off positions. For instance, when the flow valve 170 is in the closed position of FIG. 4A, e.g., due to the compressed air from air hose 154*b* entering port 171*b* of the flow valve 170 and forcing the piston 175 against the valve seat 176, any entrapped air present in the port 171*c* may be vented, for instance through the air hose 154*c* and to an exhaust port 159*a* (FIG. 3) of the actuator assembly 150. Similarly, when the flow valve 170 is in the open position of FIG. 4B, e.g., due to the compressed air from the air hose 154*c* entering port 171*c* of the flow valve and forcing the piston 175 away from the valve seat 176, any air present in the port 171*b* may be vented, for instance through the air hose 154*b* and to the exhaust port 150 of the actuator assembly 150. In addition or alternatively, entrapped air in the main valve 170 received from port 171*b* may exit this port 171*b* when the flow valve 170 is moved to an open position, and the entrapped air may be routed through the one of the actuators 166, 150, e.g., through exhaust or vent ports described herein and vented to atmosphere. In some implementations, the flow valve 170 may include a mechanical biasing mechanism such as a return spring to facilitate movement of the piston 175 to the closed position.

In some implementations, the actuator assemblies and the controller valves may be biased such as spring loaded. For instance, depressing the trigger 151 against a spring force may cause trigger valve 152 to shift from its initial or normal position and the flow valve 170 to move to an open or on position as provided herein. When the trigger 151 is released, the spring relaxes and may cause the trigger valve 152 to shift back to its initial or normal position, which may cause the flow valve 170 to move to the closed or off position as provided herein.

Various changes may be made in the form, construction and arrangement of the components of the present disclosure without departing from the disclosed subject matter or without sacrificing all of its material advantages. The form described is merely explanatory, and it is the intention of the following claims to encompass and include such changes. Moreover, while the present disclosure has been described with reference to various embodiments, it will be understood that these embodiments are illustrative and that the scope of the disclosure is not limited to them. Many variations, modifications, additions, and improvements are possible. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A pneumatic excavator, comprising:

an elongated barrel having an ingress and an egress, the ingress configured to be fluidly connected to a supply of compressed air, the egress defining an outlet of the pneumatic excavator;

an actuator comprising an actuation switch;

a releasable coupling configured to releasably couple the actuator to the barrel in a plurality of locked positions along a length of the barrel, such that the actuator is movably coupled to an exterior of the barrel; and a flow valve fixedly arranged to the barrel, wherein the flow valve is in a communicative coupling with the actuator by an actuation conduit, wherein the actuation conduit comprises a first flexible tubing and a second flexible tubing, the first tubing extending between a first port of the actuator and a first port of the flow valve, the second tubing extending between a second port of the actuator and a second port of the flow valve, wherein the actuation conduit is configured to be slaved by an adjustment movement of the actuator relative to the flow valve along the length of the barrel to thereby maintain the communicative coupling therebetween such that when the actuator is actuated, the actuation conduit sends a signal of compressed air emitted from the actuator, via the first tubing, to the flow valve to move to an open position and the supply of compressed air passes through the flow valve and the barrel and exits the pneumatic excavator through the outlet, and when the actuator is released, the actuation conduit sends a signal of compressed air, via the second tubing, to the flow valve to move to a closed position to prevent the supply of compressed air from passing through the flow valve.

2. The pneumatic excavator of claim 1, wherein at least one of the first or the second tubing is coiled tubing configured to be coiled around or strung along the barrel.

3. The pneumatic excavator of claim 1, wherein the releasable coupling comprises a sleeve-shaped portion surrounding the barrel, which may be locked and unlocked by a locking mechanism.

4. The pneumatic excavator of claim 3, wherein the locking mechanism comprises a clamp.

5. The pneumatic excavator of claim 1, wherein the actuator further comprises a first handle, wherein the first handle is configured to be held by one hand of a user and provide access to the actuation switch by the one hand.

6. The pneumatic excavator of claim 5, further comprising a second handle positioned on the exterior of the barrel.

7. The pneumatic excavator of claim 6, wherein the second handle is configured to releasably couple to the barrel in a plurality of locked positions along the length of the barrel independent from the releasable coupling.

8. The pneumatic excavator of claim 1, further comprising a nozzle coupled to the egress of the barrel and defining the outlet of the pneumatic excavator.

9. The pneumatic excavator of claim 1, further comprising an adjustable shield slidably arranged on the barrel proximate a distal end.

10. The pneumatic excavator of claim 1, wherein the actuator is a primary actuator, and the pneumatic excavator further comprises a safety mechanism comprising a secondary actuator, wherein the actuation switch and the secondary actuator are both actuated for the primary actuator to be actuated.

11. A pneumatic excavator, comprising:

an elongated barrel having an ingress and an egress, the ingress configured to be fluidly connected to a supply of compressed air, the egress defining an outlet of the pneumatic excavator;

an actuator comprising an actuation switch;

a releasable coupling configured to releasably couple the actuator to the barrel in a plurality of locked positions along a length of the barrel, such that the actuator is movably coupled to an exterior of the barrel; and a flow valve fixedly arranged to the barrel, wherein the flow valve is in a communicative coupling with the actuator by an actuation conduit, wherein the actuation conduit comprises tubing that is flexible and telescopic and is slaved by an adjustment movement of the actuator relative to the flow valve along the length of the barrel to thereby maintain the communicative coupling therebetween such that when the actuator is actuated, the actuation conduit sends a signal of compressed air emitted from the actuator to the flow valve to move to an open position and the supply of compressed air passes through the flow valve and the barrel and exits the pneumatic excavator through the outlet, and when the actuator is released, the actuation conduit sends another signal of compressed air to the flow valve to move to a closed position to prevent the supply of compressed air from passing through the flow valve.

12. The pneumatic excavator of claim 11, wherein the actuator is a primary actuator, and the pneumatic excavator further comprises a safety mechanism comprising a secondary actuator, wherein the actuation switch and the secondary actuator are both actuated for the primary actuator to be actuated.

13. A pneumatic excavator, comprising:

an elongated barrel having an ingress and an egress, the ingress configured to be fluidly connected to a supply of compressed air, the egress defining an outlet of the pneumatic excavator;

an actuator comprising an actuation switch;

a releasable coupling configured to releasably couple the actuator to the barrel in a plurality of locked positions along a length of the barrel, such that the actuator is movably coupled to an exterior of the barrel; and a flow valve fixedly arranged to the barrel, wherein the flow valve is in a communicative coupling with the actuator by an actuation conduit, wherein the actuation conduit comprises a flexible electrical conduit and is slaved by an adjustment movement of the actuator relative to the flow valve along the length of the barrel to thereby maintain the communicative coupling therebetween, wherein signals from the electrical conduit are electrical signals emitted from the actuator such that when the actuator is actuated, the actuation conduit sends a signal to the flow valve to move to an open position and the supply of compressed air passes through the flow valve and the barrel and exits the pneumatic excavator through the outlet, and when the actuator is released, the actuation conduit sends another signal to the flow valve to move to a closed position to prevent the supply of compressed air from passing through the flow valve.

14. The pneumatic excavator of claim 13, wherein the releasable coupling comprises a sleeve-shaped portion surrounding the barrel, which may be locked and unlocked by a locking mechanism.

15. The pneumatic excavator of claim 13, wherein the actuator is a primary actuator, and the pneumatic excavator further comprises a safety mechanism comprising a secondary actuator, wherein the actuation switch and the secondary actuator are both actuated for the primary actuator to be actuated.

16. A pneumatic excavator, comprising:

an elongated barrel having an ingress and an egress, the ingress configured to be fluidly connected to a supply of compressed air, the egress defining an outlet of the pneumatic excavator;

an actuator comprising an actuation switch;

a releasable coupling configured to releasably couple the actuator to the barrel in a plurality of locked positions along a length of the barrel, such that the actuator is movably coupled to an exterior of the barrel;

a handle positioned on the exterior of the barrel, wherein the handle is configured to releasably couple to the barrel in a plurality of locked positions along the length of the barrel independent from the releasable coupling; and a flow valve fixedly arranged to the barrel, wherein the flow valve is in a communicative coupling with the actuator by an actuation conduit, wherein the actuation conduit is flexible and is slaved by an adjustment movement of the actuator relative to the flow valve along the length of the barrel to thereby maintain the communicative coupling therebetween such that when the actuator is actuated, the actuation conduit sends a signal to the flow valve to move to an open position and the supply of compressed air passes through the flow valve and the barrel and exits the pneumatic excavator through the outlet, and when the actuator is released, the actuation conduit sends another signal to the flow valve to move to a closed position to prevent the supply of compressed air from passing through the flow valve.

17. The pneumatic excavator of claim 16, wherein the actuator is a primary actuator, and the pneumatic excavator further comprises a safety mechanism comprising a secondary actuator, wherein the actuation switch and the secondary actuator are both actuated for the primary actuator to be actuated.

18. A pneumatic excavator, comprising:

an elongated barrel having an ingress and an egress, the ingress configured to be fluidly connected to a supply of compressed air, the egress defining an outlet of the pneumatic excavator;

an actuator comprising an actuation switch;

a releasable coupling configured to releasably couple the actuator to the barrel in a plurality of locked positions along a length of the barrel, such that the actuator is movably coupled to an exterior of the barrel; and a flow valve fixedly arranged to the barrel, wherein the flow valve is in a communicative coupling with the actuator by an actuation conduit, wherein the actuation conduit is flexible and is slaved by an adjustment movement of the actuator relative to the flow valve along the length of the barrel to thereby maintain the communicative coupling therebetween such that when the actuator is actuated, the actuation conduit sends a signal to the flow valve to move to an open position and the supply of compressed air passes through the flow valve and the barrel and exits the pneumatic excavator through the outlet, and when the actuator is released, the actuation conduit sends another signal to the flow valve to move to a closed position to prevent the supply of compressed air from passing through the flow valve, wherein the actuator is a primary actuator, and the pneumatic excavator further comprises a safety mechanism comprising a secondary actuator, wherein the actuation switch and the secondary actuator are both actuated for the primary actuator to be actuated.

19. The pneumatic excavator of claim 18, wherein the actuation switch and the secondary actuator are separately arranged on the barrel such that the actuation switch is configured to be depressed by one hand of a user and the secondary actuator is configured to be depressed by another hand of the user.

20. The pneumatic excavator of claim 18, wherein the releasable coupling is a first releasable coupling, and the pneumatic excavator further comprises a second releasable coupling, the second releasable coupling comprising the secondary actuator, and wherein the first releasable coupling and the second releasable coupling are movable relative to each other along the length of the barrel.

* * * * *